US011437749B2

(12) United States Patent
Kida et al.

(10) Patent No.: US 11,437,749 B2
(45) Date of Patent: Sep. 6, 2022

(54) CONNECTOR

(71) Applicant: YAZAKI CORPORATION, Tokyo (JP)

(72) Inventors: Kousuke Kida, Makinohara (JP); Takuya Hasegawa, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/356,995

(22) Filed: Jun. 24, 2021

(65) Prior Publication Data

US 2021/0408713 A1 Dec. 30, 2021

(30) Foreign Application Priority Data

Jun. 26, 2020 (JP) ..... JP2020-110506

(51) Int. Cl.
*H01R 13/422* (2006.01)
*H01R 13/627* (2006.01)

(52) U.S. Cl.
CPC ..... *H01R 13/4223* (2013.01); *H01R 13/6272* (2013.01)

(58) Field of Classification Search
CPC ..... H01R 13/115; H01R 13/4223; H01R 13/6272; H01R 13/501
USPC ..... 439/595, 744, 353
See application file for complete search history.

(56) References Cited

U.S. PATENT DOCUMENTS 4,174,144 A * 11/1979 Le Helloco ..... H01R 13/422 439/595
RE30,277 E * 5/1980 Simmons ..... H01R 13/40 439/748
4,415,221 A * 11/1983 Inoue ..... H01R 13/20 439/849
4,448,468 A * 5/1984 Coldren ..... H01R 13/20 439/830
4,558,913 A * 12/1985 Goto ..... H01R 13/115 439/849
4,976,635 A * 12/1990 Gottardo ..... H01R 13/20 439/849
5,160,279 A * 11/1992 Sagawa ..... H01R 13/422 439/598
5,269,699 A * 12/1993 Peloza ..... H01R 13/20 439/924.1

(Continued)

FOREIGN PATENT DOCUMENTS

JP 2001-257022 A 9/2001
JP 2014026762 A * 2/2014 ..... H01R 13/115

*Primary Examiner* — Marcus E Harcum
(74) *Attorney, Agent, or Firm* — Sughrue Mion, PLLC

(57) ABSTRACT

A connector includes a terminal having a base plate portion and a pair of elastic curl portions, a connector housing having a terminal accommodating chamber, a flexible locking piece provided on a first wall of facing walls of the terminal accommodating chamber, a recessed groove provided on a second wall of the facing walls, extends from a rear side of the connector housing toward a front side of the connector housing along a terminal insertion direction of the terminal, and has a groove width smaller than a width of the base plate portion, and a contact surface formed at a front end portion of the recessed groove. When the terminal is reversely inserted, tip end contact portions of the elastic curl portions are brought into contact with the contact surface to prevent the terminal from being inserted further.

4 Claims, 11 Drawing Sheets

(56) References Cited

U.S. PATENT DOCUMENTS

| | | | | |
|---|---|---|---|---|
| 5,697,813 | A * | 12/1997 | Ikeda | H01R 13/4223 439/745 |
| 6,334,790 | B2 * | 1/2002 | Kashiyama | H01R 13/4223 439/752 |
| 6,589,079 | B2 * | 7/2003 | Kashiyama | H01R 13/422 439/912 |
| 6,626,701 | B2 * | 9/2003 | Yoshida | H01R 13/4223 439/595 |
| 6,641,437 | B2 * | 11/2003 | Tsuji | H01R 13/4223 439/595 |
| 8,403,702 | B2 * | 3/2013 | Lopes | H01R 31/06 439/595 |
| 9,692,163 | B1 * | 6/2017 | Didonato | H01R 4/70 |
| 10,193,259 | B1 * | 1/2019 | Didonato | H01R 12/712 |
| 2001/0023150 | A1 | 9/2001 | Kashiyama et al. | |
| 2008/0032557 | A1 * | 2/2008 | Wang | H01R 13/113 439/625 |
| 2008/0119084 | A1 * | 5/2008 | Hitchcock | H01R 13/506 439/541.5 |

* cited by examiner

CONNECTOR

CROSS-REFERENCE TO RELATED APPLICATIONS

This application is based on and claims priority under 35 USC 119 from Japanese Patent Application No. 2020-110506 filed on Jun. 26, 2020, the contents of which are incorporated herein by reference.

TECHNICAL FIELD

The present disclosure relates to a connector.

BACKGROUND ART

A connector used for connection of a wire harness for an automobile or the like includes a terminal having conductivity and a connector housing that is formed of a synthetic resin and is used for accommodating the terminal (for example, see JP-A-2001-257022).

The connector housing is formed with a terminal accommodating chamber and a lance (a flexible locking piece) that is provided in a manner of protruding into the terminal accommodating chamber. Further, a rib is integrally formed with the lance in a manner of protruding into the terminal accommodating chamber.

The terminal includes a base plate portion having a substantial spatula shape, a pair of elastic curl portions formed at a front side of the base plate portion, and a pair of conductor crimping portions and a pair of coating crimping portions that are formed at a rear side of the base plate portion.

In the connector, when the terminal is inserted into the terminal accommodating chamber of the connector housing in an inappropriate reverse insertion direction, a tip end of the base plate portion of the terminal is brought into contact with a contact surface of the rib, and the terminal cannot be inserted. Therefore, a reverse insertion of the terminal can be prevented.

In the connector described above, although a reverse insertion of the terminal can be prevented, a terminal insertion force may be increased when the terminal is inserted into the connector housing. That is, in a process of inserting the terminal into the terminal accommodating chamber, the lance slides on the terminal and is temporarily and elastically deformed, and a force for elastically deforming the lance is increased due to the rib provided integrally with the lance. Therefore, it is desired to prevent the reverse insertion of the terminal and reduce the terminal insertion force at the same time.

SUMMARY OF INVENTION

The present disclosure has been made in view of the above circumstances, and an object of the present disclosure is to provide a connector that can prevent a reverse insertion of a terminal and can prevent an increase in a terminal insertion force.

In order to achieve the object of the present disclosure, the present disclosure is achieved by a connector including: a terminal having a base plate portion and a pair of elastic curl portions that are formed at two sides of the base plate portion and face each other from a front side to a rear side of the terminal; a connector housing having a terminal accommodating chamber configured to receive the terminal from a rear side of the connector housing; a flexible locking piece provided on a first wall of facing walls of the terminal accommodating chamber and configured to lock the terminal to restrict a movement of the terminal in a terminal detachment direction; a recessed groove provided on the second wall of the facing walls, extends from the rear side of the connector housing toward a front side of the connector housing along a terminal insertion direction of the terminal being opposite to the terminal detachment direction, and has a groove width smaller than a width of the base plate portion; and a contact surface formed at a front end of the recessed groove, in which when the terminal is reversely inserted, tip end contact portions of the elastic curl portions are brought into contact with the contact surface to prevent the terminal from being inserted further.

According to the connector of the present disclosure, it is possible to provide a good connector that can prevent a reverse insertion of the terminal and can prevent an increase in the terminal insertion force.

The present disclosure has been briefly described as above. Further, details of the present disclosure will be clarified by reading an aspect (hereinafter, referred to as an "embodiment") for implementing the disclosure to be described below with reference to the accompanying drawings.

DESCRIPTION OF EMBODIMENTS

Hereinafter, embodiments according to the present disclosure will be described with reference to the drawings.

Figure 1:
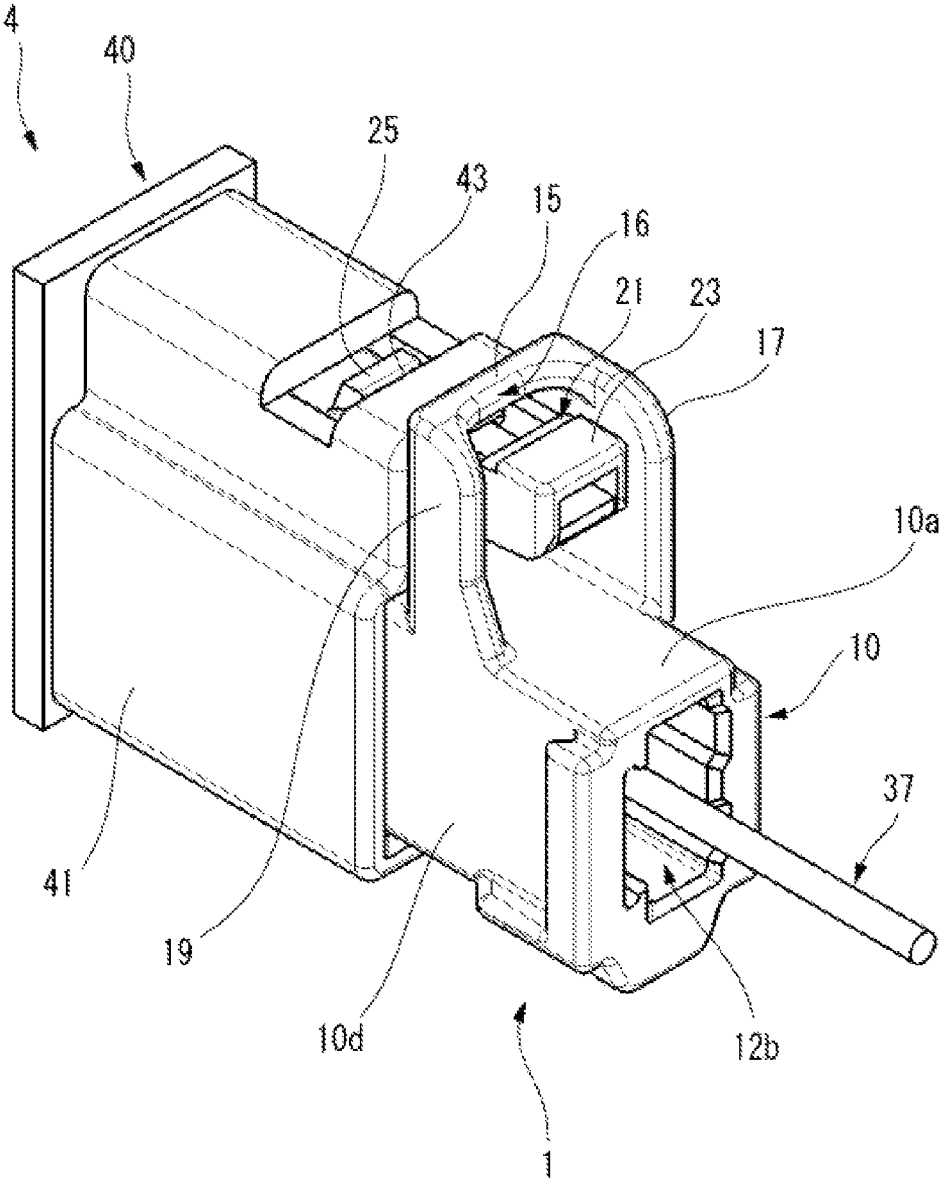
FIG. 1 is a perspective view showing a fitted state of a connector and a counterpart connector according to an embodiment of the present disclosure.
Figure 2A:
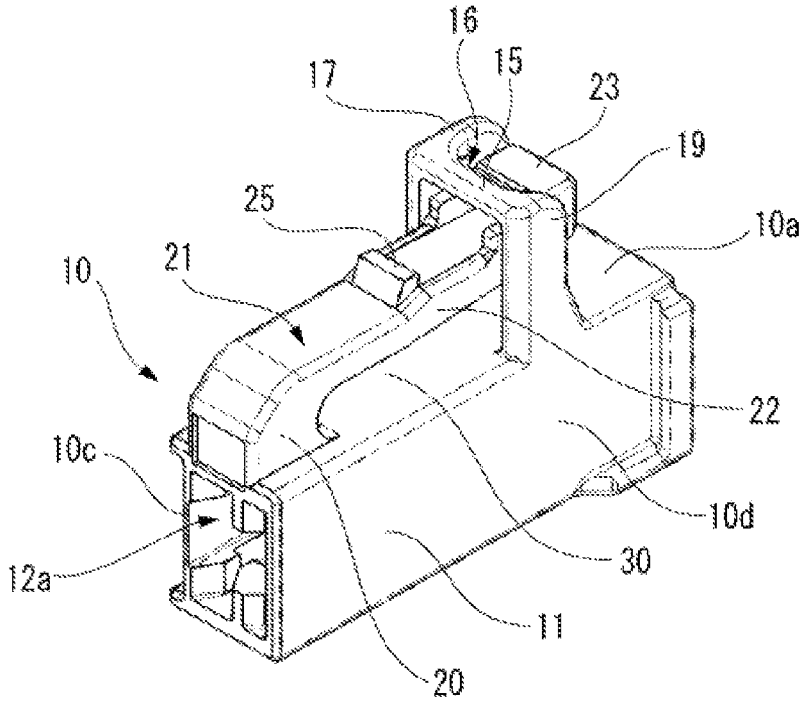
FIG. 2A is a perspective view showing a connector housing of the connector shown in FIG. 1 when viewed from a front side.
Figure 2B:
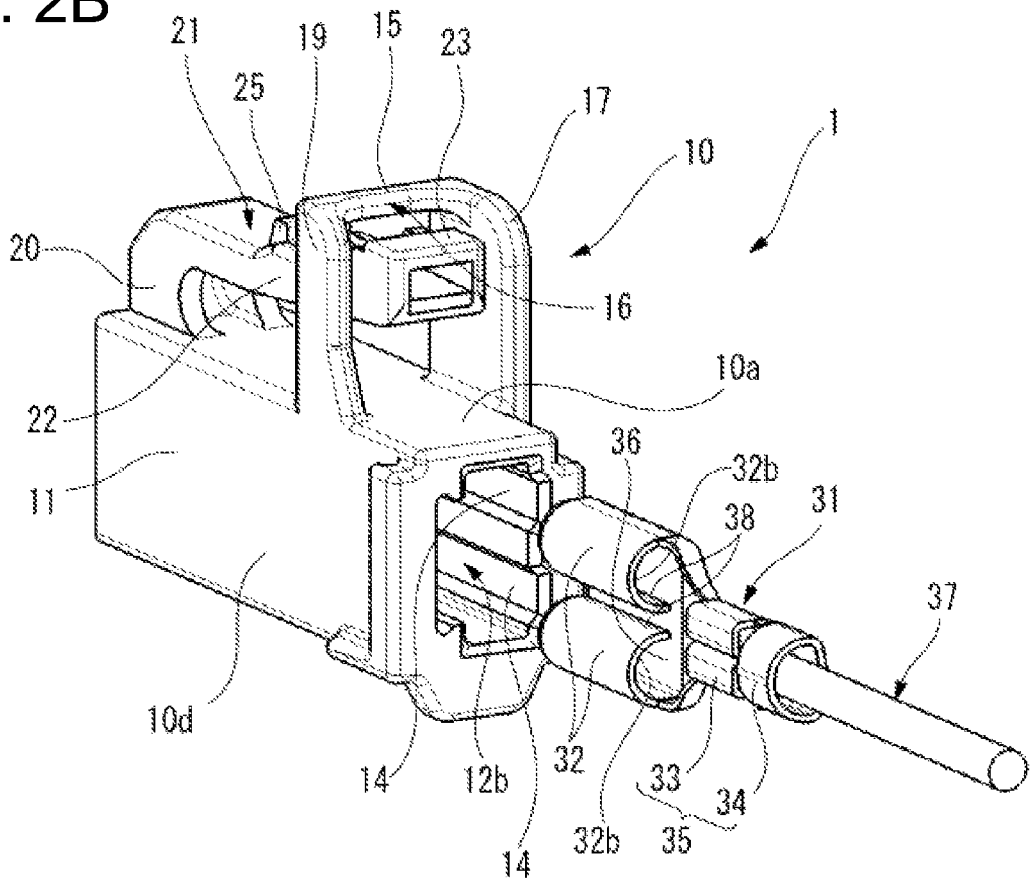
FIG. 2B is a perspective view showing a state before a terminal is inserted into the connector housing of the connector shown in FIG. 1.
Figure 3:
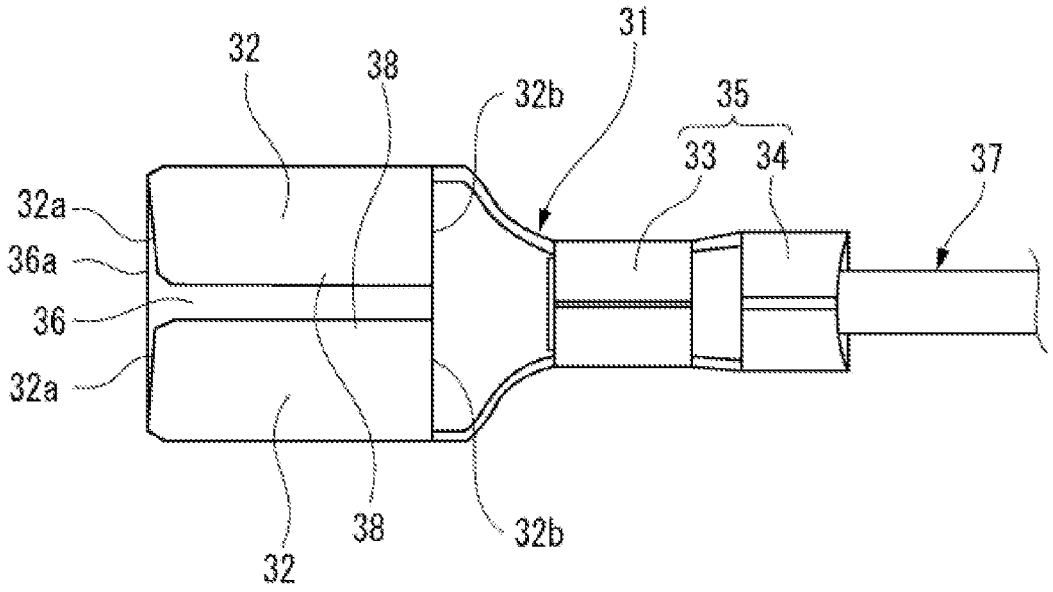
FIG. 3 is a plan view showing the terminal shown in FIG. 2B.
Figure 4:
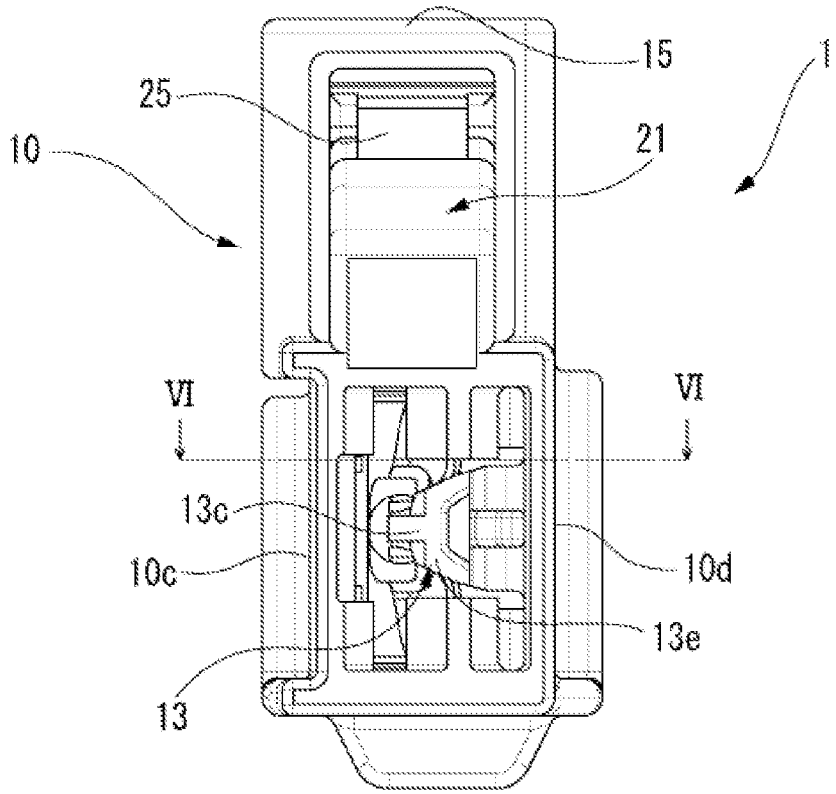
FIG. 4 is a front view showing the connector shown in FIG. 2B.
Figure 5:
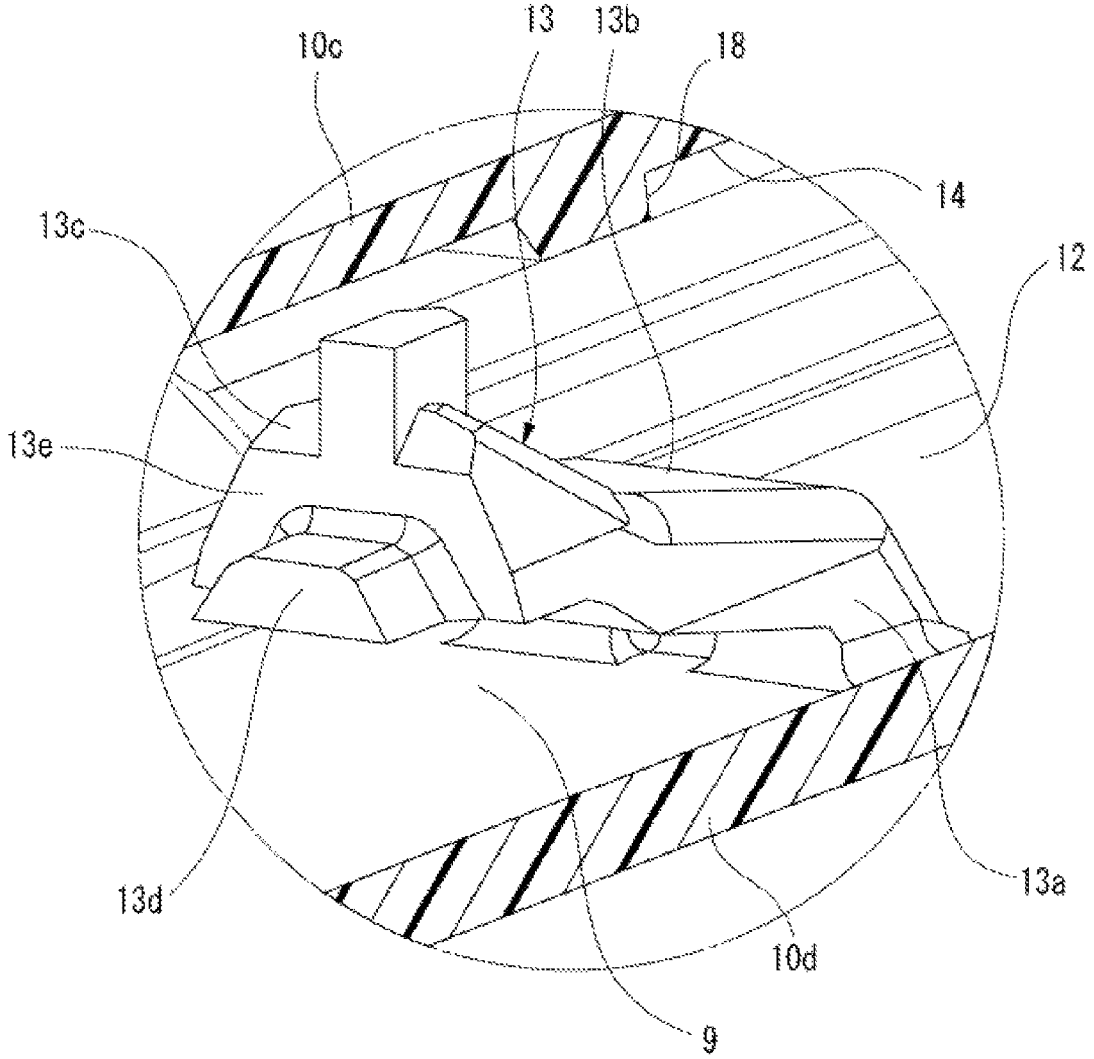
FIG. 5 is an enlarged perspective view showing a main portion of a flexible locking piece of the connector shown in FIG. 4.
Figure 6:
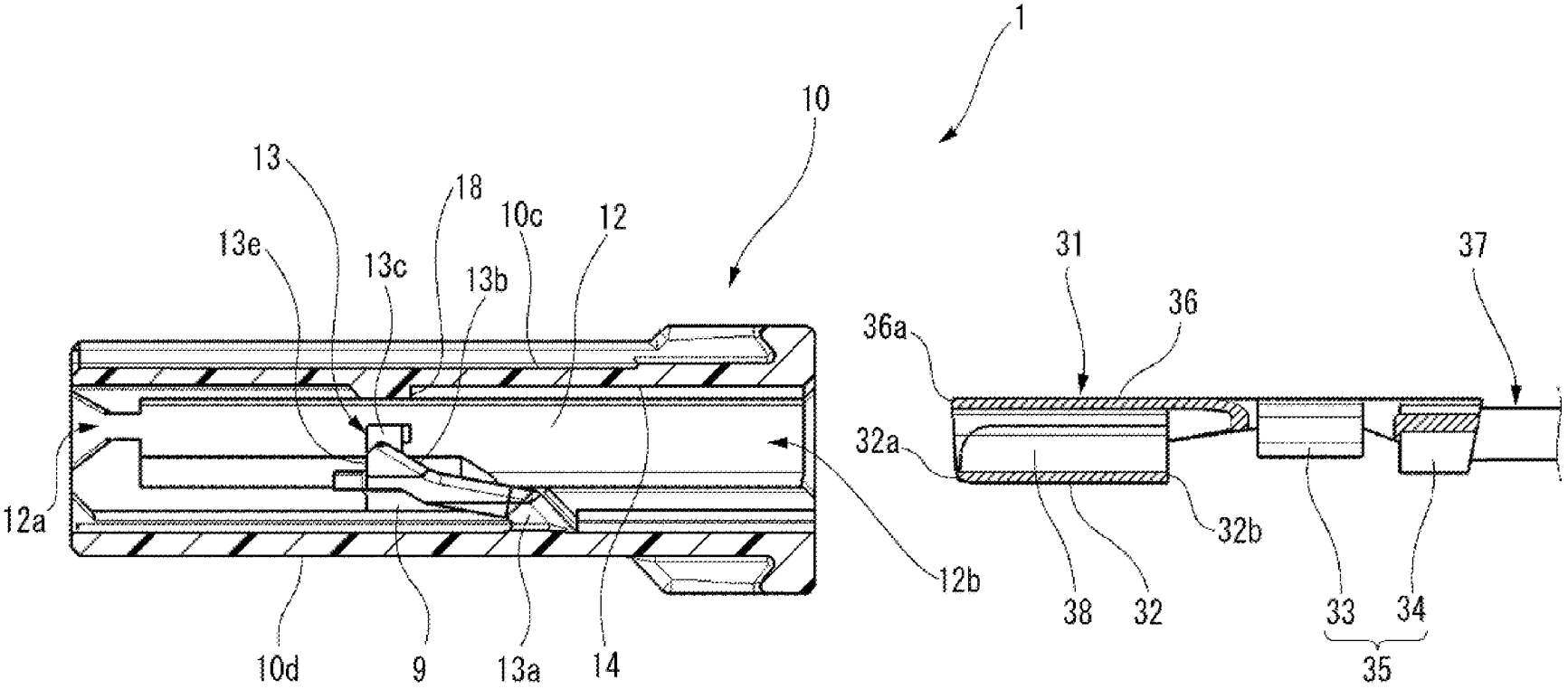
FIG. 6 is a cross-sectional view taken along a line VI-VI in FIG. 4.

FIG. 1 is a perspective view showing a fitted state of a connector 1 and a counterpart connector 4 according to an embodiment of the present disclosure. FIG. 2A is a perspective view showing a connector housing 10 of the connector 1 shown in FIG. 1 when viewed from a front side, and FIG. 2B is a perspective view showing a state before a terminal 31 is inserted into the connector housing 10 of the connector 1 shown in FIG. 1. FIG. 3 is a plan view showing the terminal 31 shown in FIG. 2B. FIG. 4 is a front view showing the connector 1 shown in FIG. 2B. FIG. 5 is an enlarged perspective view showing a main portion of a lance 13 of the connector 1 shown in FIG. 4. FIG. 6 is a cross-sectional view taken along a line VI-VI in FIG. 4.

As shown in FIGS. 1, 2A, and 2B, the connector 1 according to the present embodiment includes the connector housing 10 and the terminal 31 accommodated in a terminal accommodating chamber 12 of the connector housing 10. Here, the connector housing 10 is a female connector housing in which the terminal 31 that is a female terminal is accommodated in the terminal accommodating chamber 12. A counterpart connector housing 40 of the counterpart connector 4 is a male connector housing in which a male terminal (not shown) is provided in a connector fitting portion 41. In the following description, a side (a left side in FIG. 2A) to be fitted to the counterpart connector housing 40 is referred to as a front side of the connector housing 10.

As shown in FIGS. 2A to 6, the connector 1 according to the present embodiment mainly includes the terminal 31, the connector housing 10 having the terminal accommodating chamber 12 into which the terminal 31 is inserted from a rear side, the lance 13 that is a cantilevered flexible locking piece, is provided on a left side wall 10*d* (first wall of facing walls) of the terminal accommodating chamber 12, and locks the terminal 31 to restrict a movement of the terminal 31 in a terminal detachment direction, two recessed grooves 14 and 14 that are provided on a right side wall 10*c* (second wall of the facing walls) of the terminal accommodating chamber 12, extend from the rear side toward the front side along a terminal insertion direction (a left direction in FIG. 6) of the terminal 31, and each has a groove width smaller than a width of a base plate portion 36, and two contact surfaces 18 and 18 that are defined on the right side wall 10*c* of the terminal accommodating chamber 12 by front end portions (left end portions in FIG. 6) of the two recessed grooves 14.

As shown in FIGS. 3 and 6, the terminal 31 according to the present embodiment is a flat terminal in which the base plate portion 36 that has a substantially rectangular flat plate shape and serves as an electrical contact portion and a pair of elastic curl portions 32 and 32 that are formed at two sides of the base plate portion 36 and face each other from the front side to the rear side are formed at a tip end of the terminal 31 in the terminal insertion direction. The elastic curl portions 32 are formed at the two sides of the base plate portion 36 in a manner of being bent inward in a substantial mountain shape in a cross-sectional view. In the terminal 31, an electric wire connection portion 35 including a conductor crimping portion 33 that crimps a conductor of an electric wire 37 and a coating crimping portion 34 that fixes the electric wire 37 is continuously provided at a rear side of the base plate portion 36.

The connector housing 10 according to the present embodiment includes a lock arm 21 formed on an upper wall 10*a* of the terminal accommodating chamber 12, a pair of plate-shaped support walls 17 and 19 that protrude to a rear side of the upper wall 10*a* and sandwich a rear portion of the lock arm 21, a coupling portion 15 that couples upper ends of the pair of plate-shaped support walls 17 and 19 in a width direction (a left-right direction in FIG. 4) in a manner of crossing over the rear portion of the lock arm 21, and a lock operation space 16 formed by cutting a notch at a rear end of the coupling portion 15 so as to allow a finger to press against the rear portion of the lock arm 21.

As shown in FIG. 1, the counterpart connector housing 40 according to the present embodiment is formed as a molded product of a synthetic resin, and includes the connector fitting portion 41 having a quadrangular tubular shape. A fitting portion 11 of the connector housing 10, which will be described later, is inserted and fitted into the connector fitting portion 41 in a substantially close contact state. A tab terminal portion of the male terminal is provided on a back wall of the connector fitting portion 41 in a manner of protruding toward an opening end.

A lock portion 43 that is formed by cutting a notch is provided on a top wall of the connector fitting portion 41. A lock claw (lock protrusion) 25 of the lock arm 21, which will be described later, is locked to the lock portion 43.

As shown in FIGS. 2A, 2B, 4, and 5, the connector housing 10 according to the present embodiment is formed as a molded product of a synthetic resin, and has a substantially rectangular tubular shape as a whole. A front half of the connector housing 10 serves as the fitting portion 11 that can be inserted into the connector fitting portion 41 of the counterpart connector housing 40. An inner side of the connector housing 10 including the fitting portion 11 serves as the terminal accommodating chamber 12 of the terminal 31 that receives a male terminal of the counterpart connector housing 40 through a front end opening 12*a*.

As shown in FIGS. 5 and 6, the lance 13 that locks the terminal 31 to restrict a movement of the terminal 31 in the terminal detachment direction is provided on an inner surface of the left side wall 10*d* of the terminal accommodating chamber 12 in a manner of protruding into the terminal accommodating chamber 12. The terminal 31 that is inserted into the terminal accommodating chamber 12 from a rear end opening 12*b* that is located at a rear side of the connector housing 10 is held in the terminal accommodating chamber 12. A flexible displacement permitting space 9 for the lance 13 is formed at the left side wall 10*d* side. The flexible displacement permitting space 9 is a space (gap) ensured to elastically deform the lance 13.

The lance 13 is a cantilevered flexible locking piece that extends from a substantially center portion in a front-rear direction of the left side wall 10*d* toward a terminal insertion direction side of the terminal 31, and is formed to restrict a movement of the terminal 31 in the terminal detachment direction opposite to the terminal insertion direction when the terminal 31 is completely accommodated in the terminal accommodating chamber 12.

The lance 13 includes a base end portion 13*a*, an intermediate portion 13*b*, a lock protrusion portion 13*c*, and a tip end portion 13*d*. The lance 13 is formed in a manner in which the tip end portion 13*d* is bent (elastically deformed) toward the left side wall 10*d* and the lock protrusion portion 13*c* is engaged with the terminal 31.

The base end portion 13*a* is a portion continuous with a substantially center portion in the front-rear direction of the left side wall 10*d*, and one end of the intermediate portion 13*b* is continuously formed at a tip end in a protruding direction of the base end portion 13*a*. The intermediate portion 13*b* is formed into a flat rod shape or a flat plate shape. The intermediate portion 13*b* is formed in a manner in which the other end of the intermediate portion 13*b* extends obliquely from the base end portion 13*a* toward the right side wall 10*c*.

The lock protrusion portion 13*c* and the tip end portion 13*d* are continuously formed at the other end of the intermediate portion 13*b* and in the vicinity of the other end of the intermediate portion 13*b*. The other end of the intermediate portion 13*b* is formed on a surface orthogonal to the terminal insertion direction.

The lock protrusion portion 13*c* is formed at a corner of the other end of the intermediate portion 13*b* at a side close to the right side wall 10*c*. The lock protrusion portion 13*c* has a lock surface 13*e* that engages with the terminal 31 at the other end of the intermediate portion 13*b*.

The lock protrusion portion 13*c* is formed in a manner in which a tip end of the lock protrusion portion 13*c* extends vertically from the other end of the intermediate portion 13*b* toward the right side wall 10*c*.

The tip end portion 13*d* is formed at the other end of the intermediate portion 13*b* in a manner of protruding from the left side wall 10*d*. The tip end portion 13*d* is formed into a trapezoidal shape in a front view in which the right side wall 10*c* side is narrowed. Each oblique side of the trapezoidal shape (each inclined surface of the tip end portion 13*d*) is formed to substantially coincide with an inclination of each of inclined surfaces 38 and 38 (see FIG. 2B and FIG. 3) at an inner side of the pair of elastic curl portions 32 and 32 to be described later. The tip end portion 13*d* is reliably positioned in the flexible displacement permitting space 9 when the lance 13 is bent.

As shown in FIGS. 2A and 6, two recessed grooves 14 that extend from the rear side to the front side along the terminal insertion direction of the terminal 31 are provided on an inner surface of the right side wall 10*c* of the terminal accommodating chamber 12. Each of the two recessed grooves 14 has a groove width smaller than a width of the base plate portion 36, and extends in parallel in correspondence with an interval between the pair of elastic curl portions 32 and 32. Although a cross section of the recessed grooves 14 according to the present embodiment is formed to have a trapezoidal shape in which a bottom portion side is narrowed, it is needless to say that the cross section of the recessed grooves 14 may have various kinds of shapes such as a rectangular shape and a semicircular shape.

The contact surfaces 18 are defined by front end portions of the recessed grooves 14 on an inner surface of the right side wall 10*c* at an intermediate portion in the terminal insertion direction of the terminal accommodating chamber 12. Although the contact surfaces 18 are formed as surfaces substantially orthogonal to the terminal insertion direction, the contact surfaces 18 are preferably inclined surfaces inclined from the inner surface of the right side wall 10*c* to a rear side. That is, tip end contact portions 32*a* and 32*a* of the elastic curl portions 32 and 32 to be brought into contact with the contact surfaces 18 can be reliably locked by forming the contact surfaces 18 into inclined surfaces that are inclined to a rear side.

The contact surfaces 18 are disposed at positions substantially facing the locking lance 13. Therefore, when the tip end contact portions 32*a* and 32*a* of the elastic curl portions 32 and 32 are brought into contact with the contact surfaces 18, the base plate portion 36 is elastically biased by the lance 13 toward the right side wall 10*c*, so that the tip end contact portions 32*a* and 32*a* can be reliably brought into contact with the contact surface 18.

A length of the recessed groove 14 from the rear end opening 12*b* to the contact surface 18 is shorter than a length from the tip end contact portions 32*a* and 32*a* of the elastic curl portions 32 and 32 to a rear end of the electric wire connection portion 35 in the terminal 31. Therefore, when the tip end contact portions 32*a* and 32*a* of the elastic curl portions 32 and 32 are brought into contact with the contact surfaces 18, the electric wire connection portion 35 of the terminal 31 is exposed from a rear side of the terminal accommodating chamber 12.

As shown in FIGS. 2A and 2B, the lock arm 21 that keeps a fitted state by being elastically engaged with the counterpart connector housing 40 is formed on the upper wall 10*a* of the connector housing 10.

The lock arm 21 includes a cantilevered arm portion 22 that extends from a base end portion 20 raised from the upper wall 0*a* of the connector housing 10 to a rear side and is spaced from the upper wall 10*a* of the connector housing 10 with an interval between the lock arm 21 and the upper wall 10*a*. A flexible space (gap) 30 is provided between the upper wall 10*a* of the connector housing 10 and a lower face of the arm portion 22 and allows a flexural deformation of the arm portion 22 when the connector housing 10 is fitted to the counterpart connector housing 40.

Therefore, when a rear end portion (free end portion) of the lock arm 21 receives an operation force, the lock arm 21 is bent and deformed in a pressing direction (downward direction in FIGS. 2A and 2B), and when the operation force is no longer applied, the lock arm 21 is restored to the original cantilevered state by an own repulsive force. The lock arm 21 has, on an upper face of an intermediate portion of the arm portion 22, a lock claw 25 to be locked to the lock portion 43 of the counterpart connector housing 40. In addition, a lock operation portion 23 that protrudes upward is provided on an upper face of a rear end portion of the arm portion 22.

That is, the lock arm 21 keeps a fitted state of the connector housing 10 and the counterpart connector housing 40 by locking the lock claw 25 to the lock portion 43 of the counterpart connector housing 40. When the lock operation portion 23 is pressed downward by a finger or the like, an operation force is intensively applied to the lock operation portion 23, and the rear end portion of the lock arm 21 is bent and deformed downward.

The pair of plate-shaped support walls 17 and 19 according to the present embodiment are provided in a manner of protruding upward at a rear side of the upper wall 10*a* and sandwich the rear end portion of the lock arm 21 including the lock operation portion 23 in the width direction. The pair of plate-shaped support walls 17 and 19 are arranged in parallel with each other and are spaced from the lock arm 21 with small gaps between the pair of plate-shaped support walls 17 and 19 and two side faces of the lock arm 21.

The coupling portion 15 according to the present embodiment couples upper ends of the pair of plate-shaped support walls 17 and 19 in the width direction in a manner of crossing over the rear portion of the lock arm 21. The lock operation space 16 is formed by cutting a notch at a rear end of the coupling portion 15 so that a finger can press against the lock operation portion 23 of the lock arm 21.

Next, an operation of inserting the terminal 31 into the terminal accommodating chamber 12 of the connector 1 having the configuration described above will be described.

Figure 7A:
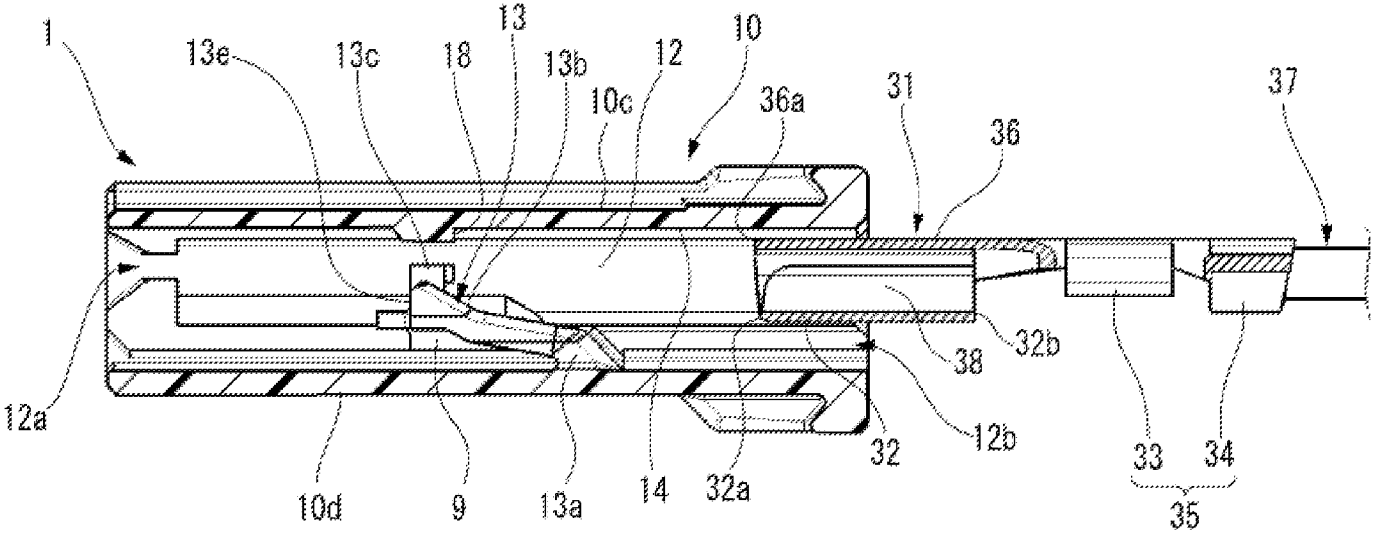
FIG. 7A and FIG. 7B are views showing a terminal insertion procedure of the connector shown in FIG. 6.
Figure 7B:
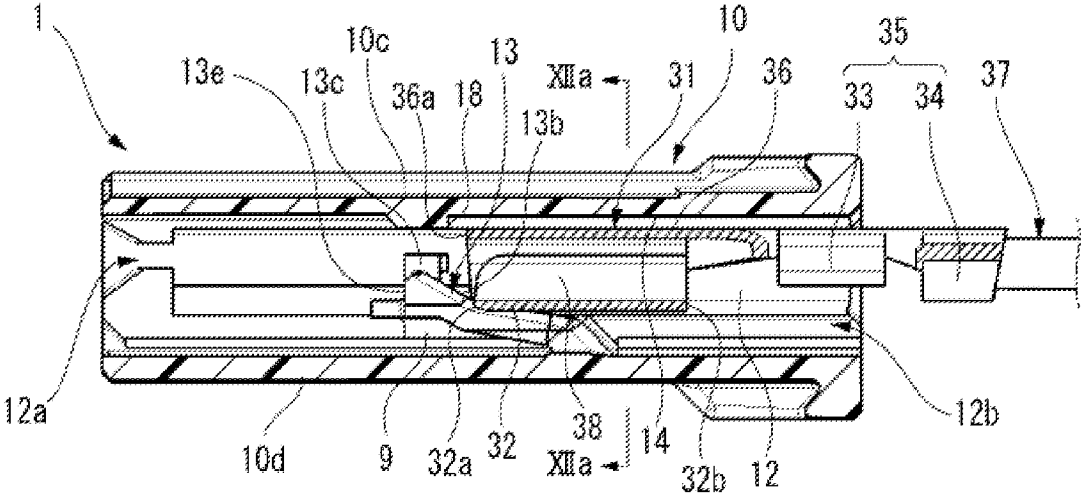
Figure 11:
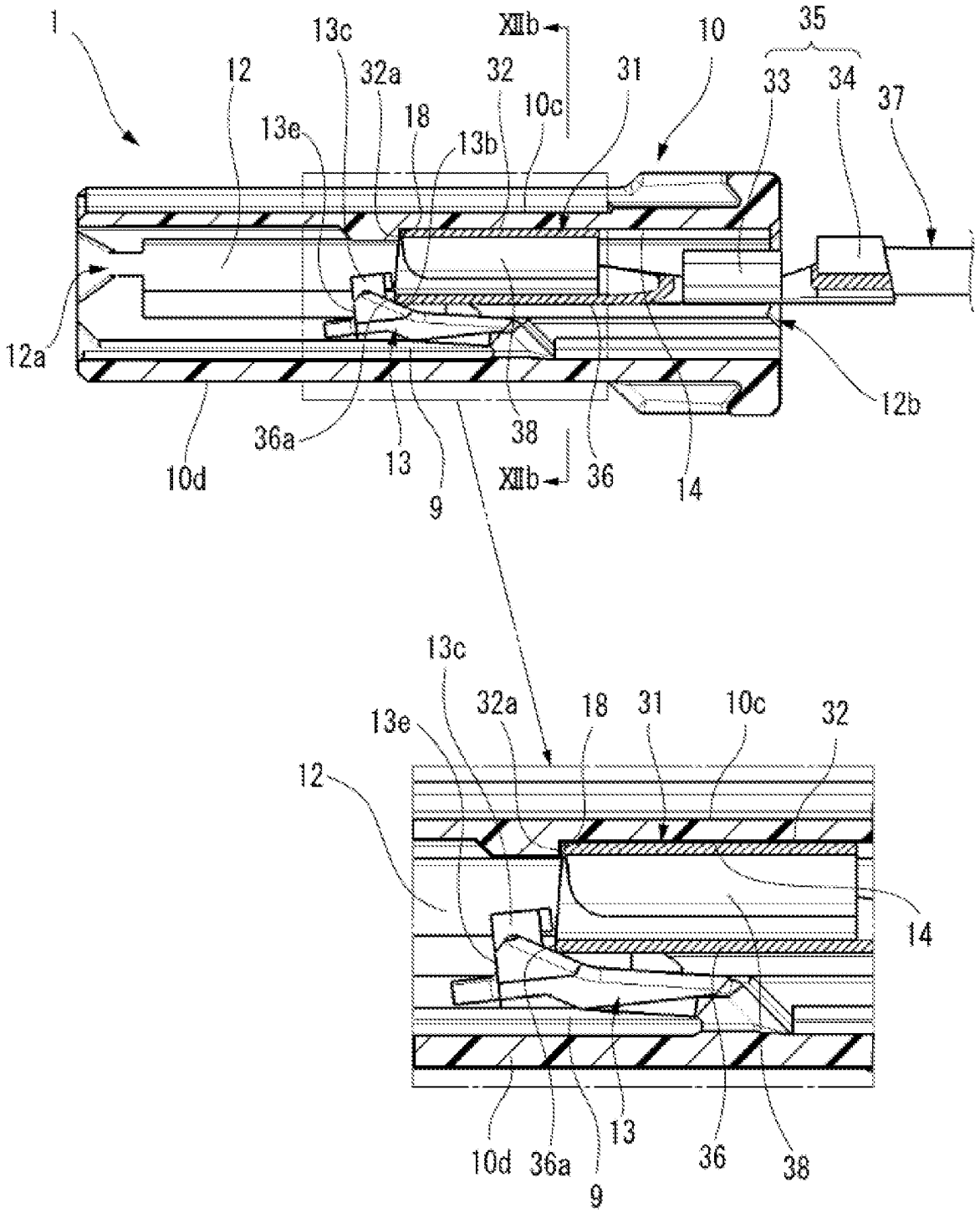
FIG. 11 is a view showing an entire of prevention of a reverse insertion of the terminal into the connector shown in FIG. 6 and an enlarged part thereof.
Figure 12B:
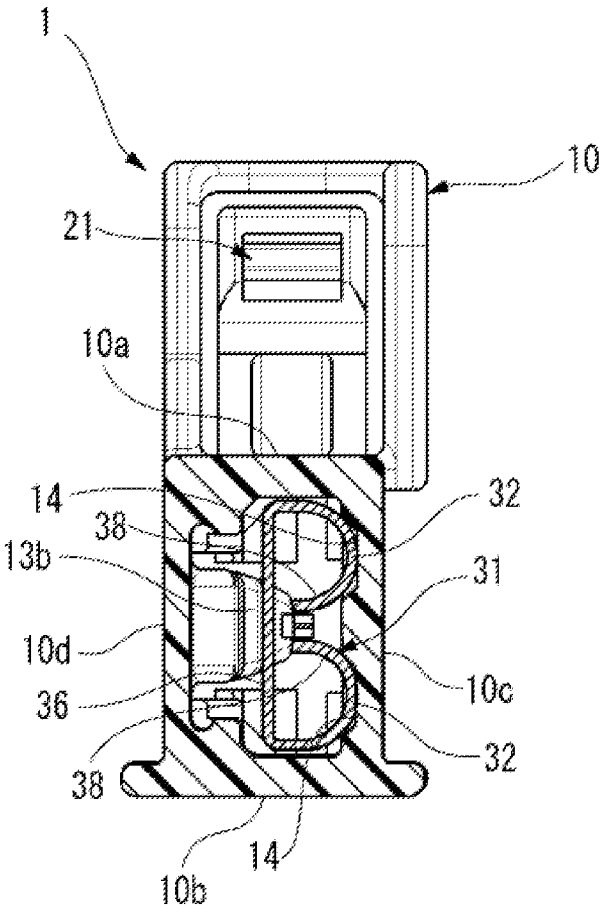
FIG. 12B is a cross-sectional view taken along a line XIIb-XIIb in FIG. 11.
Figure 12A:
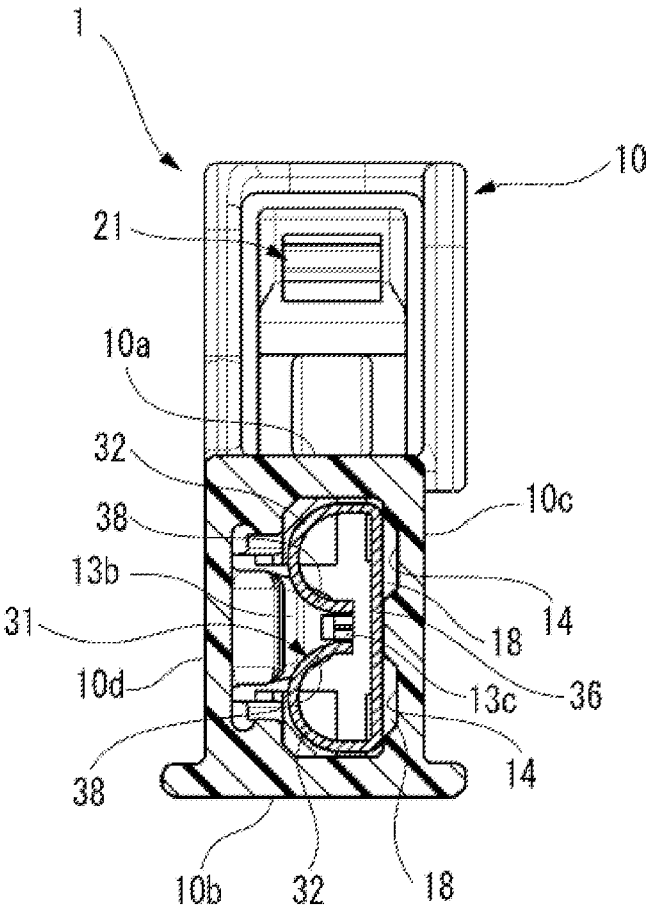
FIG. 12A is a cross-sectional view taken along a line XIIa-XIIa in FIG. 7B.

FIGS. 7A and 7B and FIGS. 8A and 8B are views showing a terminal insertion procedure of the connector 1 shown in FIG. 6. FIGS. 9 to 11 are views showing prevention of a reverse insertion of the terminal of the connector 1 shown in FIG. 6. FIG. 12A is a cross-sectional view taken along a line XIIa-XIIa in FIG. 7B, and FIG. 12B is a cross-sectional view taken along a line XIIb-XIIb in FIG. 11.

First, as shown in FIG. 6, a case where the terminal 31 is inserted in an appropriate insertion direction in which the base plate portion 36 is at the right side wall 10*c* side and the pair of elastic curl portions 32 and 32 are at the left side wall 10*d* side will be described.

As shown in FIG. 7A, the terminal 31 is inserted from the rear end opening 12*b* of the terminal accommodating chamber 12.

When the terminal 31 further enters the terminal accommodating chamber 12, the tip end contact portions 32*a* and 32*a* of the pair of elastic curl portions 32 and 32 are brought into contact with the intermediate portion 13*b* of the lance 13 as shown in FIG. 7B. Since the base plate portion 36 has a width larger than a groove width of the recessed groove 14, the base plate portion 36 is in sliding contact with an inner surface of the right side wall 10*c* without being introduced into the recessed groove 14 as shown in FIG. 12A.

Figure 8A:
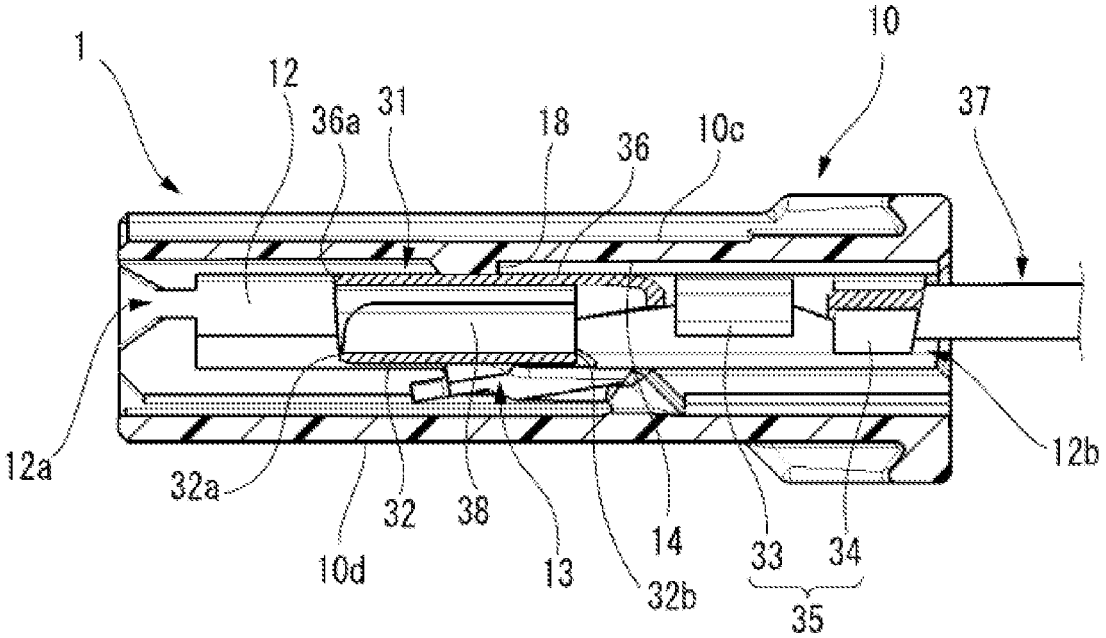
FIG. 8A and FIG. 8B are views showing a terminal insertion procedure of the connector shown in FIG. 6.
Figure 9:
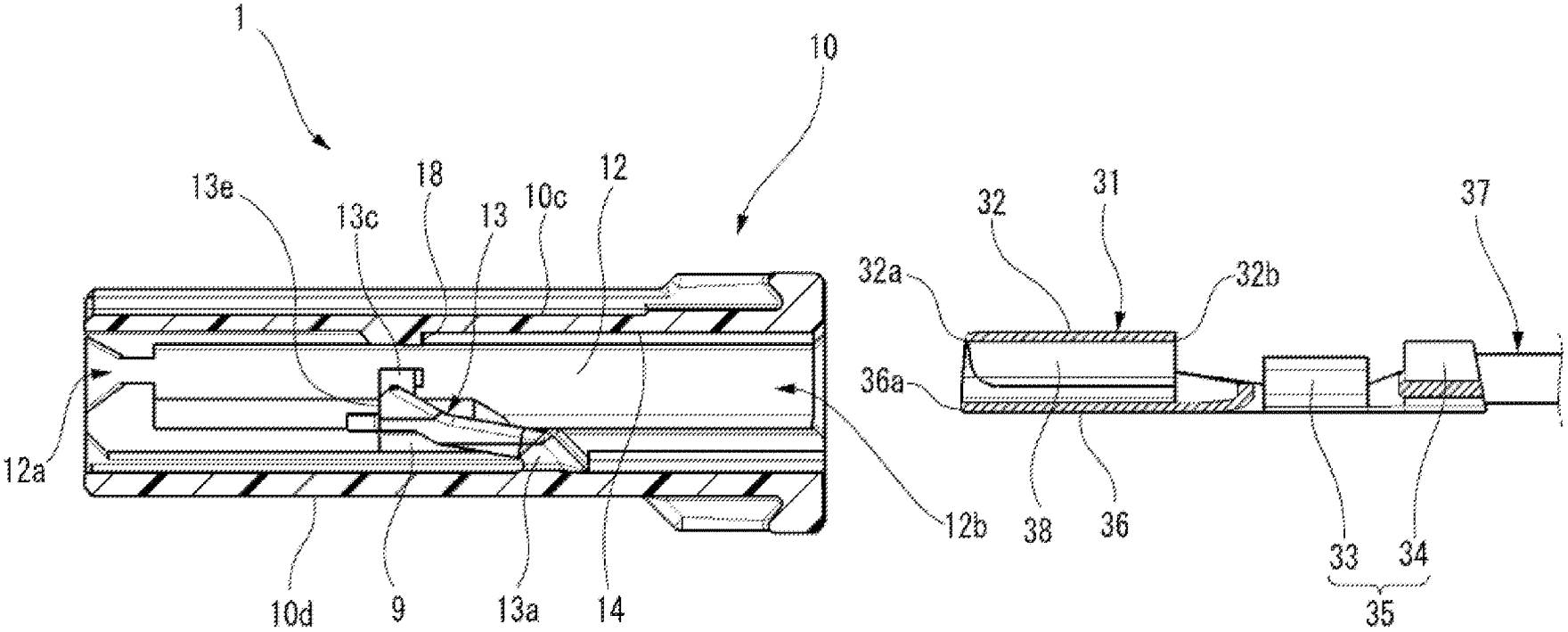
FIG. 9 is a view showing prevention of a reverse insertion of the terminal of the connector shown in FIG. 6.

When the terminal 31 is further pushed into the terminal accommodating chamber 12, the lance 13 of the terminal accommodating chamber 12 is elastically deformed by an action from the terminal 31 as shown in FIG. 8A. That is, first, the tip end contact portions 32*a* and 32*a* of the elastic curl portions 32 and 32 of the terminal 31 are brought into contact with the intermediate portion 13*b* of the lance 13, and the intermediate portion 13*b* is pressed. The lance 13 is elastically deformed in a direction in which the tip end portion 13*d* comes close to the left side wall 10*d* (elastically deformed in the flexible displacement permitting space 9). The elastic curl portions 32 and 32 are in sliding contact with the intermediate portion 13*b*. The lance 13 comes onto the elastic curl portions 32 and 32 due to the elastic deformation.

Figure 8B:
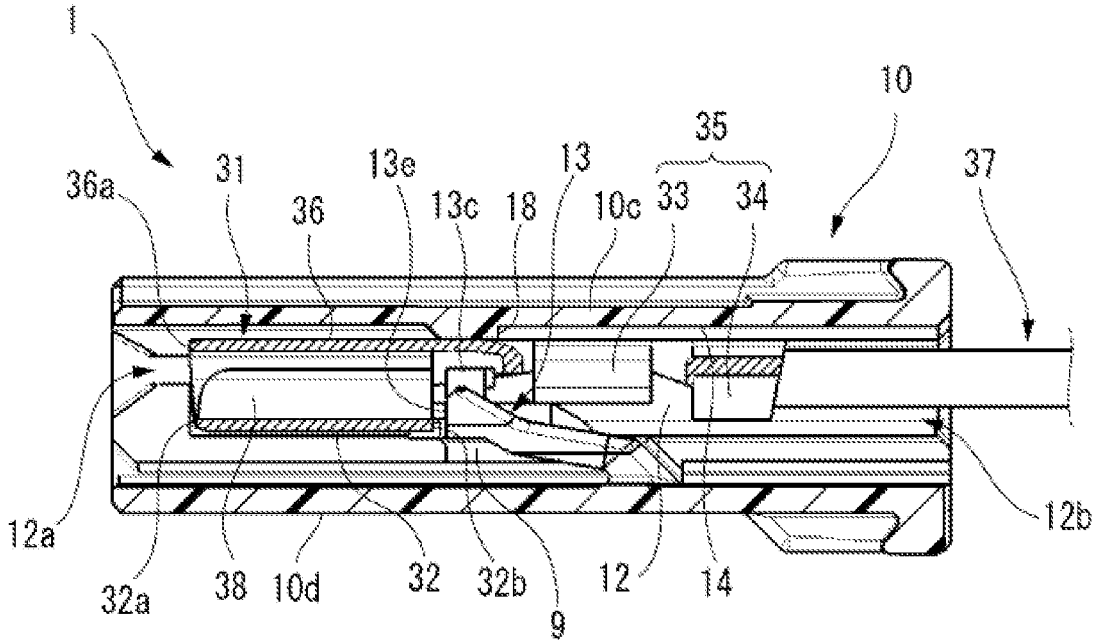

When the terminal 31 is further pushed into the terminal accommodating chamber 12 from this state and the lock protrusion portion 13*c* passes through the elastic curl portions 32 and 32 and is away from the elastic curl portions 32 and 32, the lance 13 returns to the original position due to a restoring force as shown in FIG. 8B. Then, the lock protrusion portion 13*c* is locked to rear end lock portions 32*b* of the elastic curl portions 32 and 32 to restrict a movement of the terminal 31 in the terminal detachment direction. Accordingly, the terminal 31 is completely accommodated in the terminal accommodating chamber 12. The terminal 31 is locked to the lance 13, so that the terminal 31 is prevented from coming off from the terminal accommodating chamber 12.

Next, as shown in FIG. 9, a case where the terminal 31 is inserted in an inappropriate insertion direction in which the base plate portion 36 is at the left side wall 10*d* side and the pair of elastic curl portions 32 and 32 are at the right side wall 10*c* side will be described.

Figure 10A:
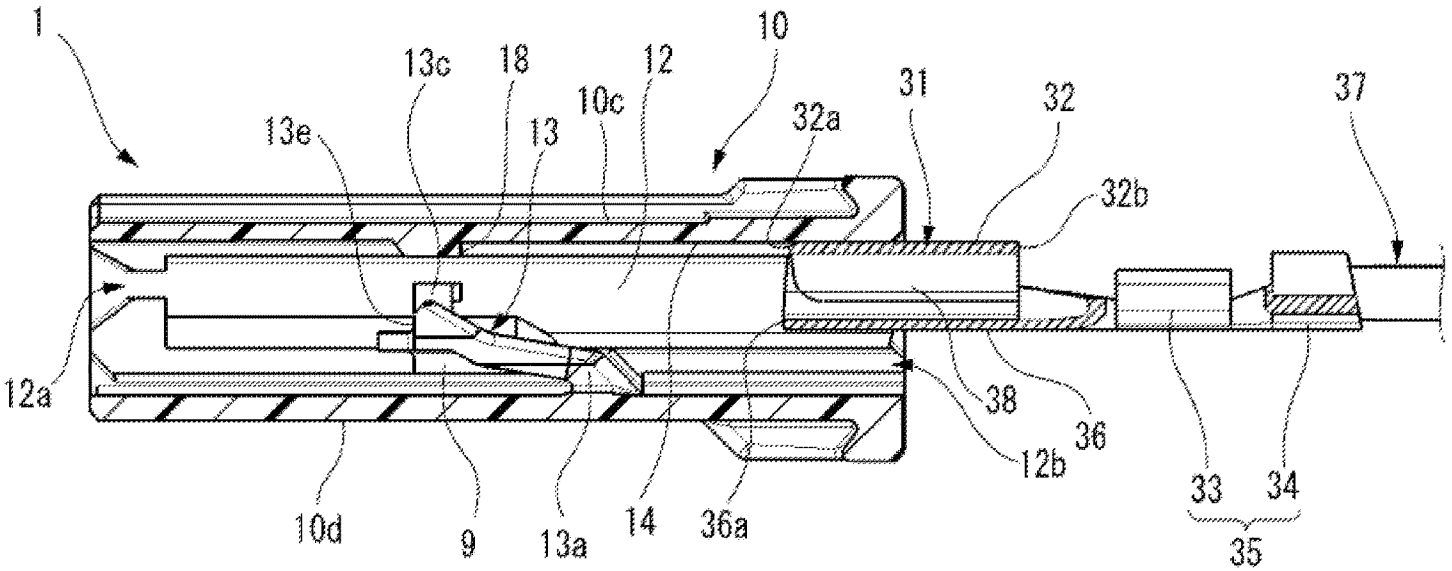
FIG. 10A and FIG. 10B are views showing prevention of a reverse insertion of the terminal of the connector shown in FIG. 6.

First, as shown in FIG. 10A, the terminal 31 is inserted from the rear end opening 12*b* of the terminal accommodating chamber 12.

Figure 10B:
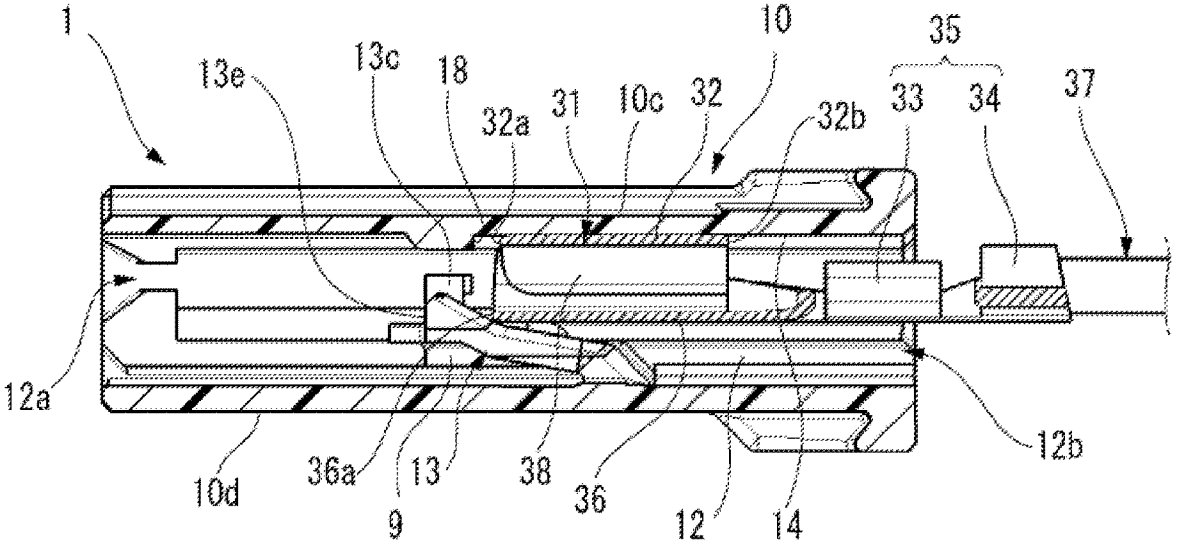

When the terminal 31 further enters the terminal accommodating chamber 12, a tip end portion 36*a* of the base plate portion 36 is brought into contact with the intermediate portion 13*b* of the lance 13 as shown in FIG. 10B. The tip end contact portions 32*a* of the elastic curl portions 32 having a smaller width than the base plate portion 36 are introduced into the recessed grooves 14 provided on the inner surface of the right side wall 10*c*.

When the terminal 31 is further pushed into the terminal accommodating chamber 12, the lance 13 of the terminal accommodating chamber 12 is elastically deformed by an action from the terminal 31 as shown in FIG. 11. That is, the tip end portion 36*a* of the base plate portion 36 of the terminal 31 is brought into contact with the intermediate portion 13*b* of the lance 13, and the intermediate portion 13*b* is pressed. The lance 13 is elastically deformed in a direction in which the tip end portion 13*d* comes close to the left side wall 10*d* (elastically deformed in the flexible displacement permitting space 9). The base plate portion 36 is in sliding contact with the intermediate portion 13*b*. The lance 13 comes onto the base plate portion 36 due to the elastic deformation.

At this time, the tip end contact portions 32*a* and 32*a* of the elastic curl portions 32 and 32 that are introduced into the recessed grooves 14 are brought into contact with the contact surfaces 18 (see FIG. 12B). Therefore, even when the terminal 31 is further pushed into the terminal accommodating chamber 12 from this state, the terminal 31 of which the tip end contact portions 32*a* and 32*a* of the elastic curl portions 32 and 32 are brought into contact with the contact surfaces 18 cannot move in the terminal insertion direction. Therefore, the terminal 31 is prevented from being inserted into the terminal accommodating chamber 12 and is not completely inserted. Here, since the terminal 31 is not locked by the lance 13 and is not prevented from coming off from the terminal accommodating chamber 12, it is easy for the terminal 31 to come off from the connector housing 10, and thus a reverse insertion of the terminal 31 can be known. Therefore, a reverse insertion of the terminal 31 can be prevented.

Next, a function of the connector 1 having the configuration described above will be described.

According to the connector 1 in the present embodiment, when the terminal 31 is inserted into the terminal accommodating chamber 12 from a rear side of the connector housing 10 in an appropriate insertion direction, the base plate portion 36 of the terminal 31 is brought into sliding contact with the right side wall 10*c* having the recessed grooves 14, and the elastic curl portions 32 of the terminal 31 elastically deforms the lance 13. Since the base plate portion 36 has a width larger than the groove width of the recessed grooves 14, the terminal 31 is not introduced into the recessed grooves 14 and is not brought into contact with the contact surfaces 18. When the terminal 31 is completely inserted while the locking lance 13 is elastically deformed, the locking lance 13 returns to the original position due to a restoring force and locks the terminal 31 to restrict a movement of the terminal 31 in the terminal detachment direction. Therefore, the terminal 31 is prevented from coming off from the terminal accommodating chamber 12 by the lance 13.

When the terminal 31 is inserted into the terminal accommodating chamber 12 in an inappropriate reverse insertion direction, the elastic curl portions 32 of the terminal 31 are brought into sliding contact with the right side wall 10*c* having the recessed grooves 14, and the base plate portion 36 of the terminal 31 elastically deforms the lance 13. At this time, the tip end contact portions 32*a* of the elastic curl portions 32 having a width smaller than the width of the base plate portion 36 are introduced into the recessed grooves 14 provided on the right side wall 10*c*. When the terminal 31 is inserted halfway, the tip end contact portions 32*a* of the elastic curl portions 32 that are introduced into the recessed grooves 14 are brought into contact with the contact surfaces 18, so that the terminal 31 is prevented from being inserted into the terminal accommodating chamber 12 and the terminal 31 is not completely inserted. Therefore, a reverse insertion of the terminal 31 can be prevented.

That is, the lance 13 does not need to be integrally provided with a rib in order to prevent a reverse insertion of the terminal 31. Rigidity of the lance 13 is increased due to the rib that is integrally provided with the lance 13. Therefore, an increase in a force for elastically deforming the lance 13 due to an increase in the rigidity of the lance 13 does not occur.

Therefore, according to the connector 1 having the present configuration, it is possible to prevent a reverse insertion when the terminal 31 is inserted into the terminal accommodating chamber 12 and it is possible to prevent an increase in a terminal insertion force.

In the connector 1 according to the present embodiment, the contact surfaces 18 are provided on the right side wall 10*c* such that the electric wire connection portion 35 of the terminal 31 in a state in which the terminal 13 is reversely inserted and is prevented from being inserted is exposed from a rear side of the terminal accommodating chamber 12.

Therefore, in a case in which the terminal 31 is inserted into the terminal accommodating chamber 12 in an inappropriate reverse insertion direction, when the tip end contact portions 32*a* of the elastic curl portions 32 are brought into contact with the contact surfaces 18 to prevent the terminal 31 from being inserted, the electric wire connection portion 35 of the terminal 31 is exposed from the rear side of the terminal accommodating chamber 12. Therefore, the reverse insertion of the terminal 31 can be easily detected (or known).

In the connector 1 according to the present embodiment, the contact surfaces 18 are provided on the right side wall 10*c* such that the base plate portion 36 of the terminal 31 in a state in which the terminal 31 is reversely inserted and is prevented from being inserted is elastically biased toward the right side wall 10*c* by the lance 13.

Therefore, in a case in which the terminal 31 is inserted into the terminal accommodating chamber 12 in an inappropriate reverse insertion direction, the tip end contact portions 32*a* of the elastic curl portions 32 are brought into contact with the contact surfaces 18 to prevent the terminal 31 from being inserted. At this time, when the base plate portion 36 is elastically biased toward the right side wall 10*c* by the lance 13, the tip end contact portions 32*a* of the elastic curl portions 32 can be reliably brought into contact with the contact surfaces 18. Therefore, a reverse insertion of the terminal 31 can be reliably prevented regardless of dimensional tolerances of the connector housing 10 and the terminal 31.

In the connector 1 according to the present embodiment, the two recessed grooves 14 extend in parallel in correspondence with an interval between the pair of elastic curl portions 32 and 32.

Therefore, when the terminal 31 is inserted into the terminal accommodating chamber 12 in an inappropriate reverse insertion direction, the tip end contact portions 32*a* of the pair of elastic curl portions 32 and 32 are respectively brought into contact with the corresponding contact surfaces 18, and the terminal 31 is reliably prevented from being inserted. Therefore, a reverse insertion of the terminal 31 in which the tip end contact portions 32*a* of the pair of elastic curl portions 32 and 32 are respectively brought contact with the contact surfaces 18 is reliably prevented.

Therefore, according to the connector 1 in the embodiment described above, it is possible to provide a good connector that can prevent a reverse insertion of the terminal 31 and can prevent an increase in a terminal insertion force.

The present disclosure is not limited to the embodiment described above, and may be appropriately modified, improved, and the like. In addition, a material, shape, size, number, arrangement position, and the like of each component in the embodiment described above are optional and are not limited as long as the present disclosure can be achieved.

Here, features of the embodiment of the connector according to the present disclosure described above will be briefly summarized and listed in the following [1] to [4].

[1] The connector (1) includes a terminal (31) including a base plate portion (36) and a pair of elastic curl portions (32, 32) that are formed at two sides of the base plate portion (36) and face each other from a front side to a rear side of the terminal, a connector housing (10) having the terminal accommodating chamber (12) configured to receive the terminal (31) from a rear side of the connector housing, a flexible locking piece (the lance 13) provided on a first wall (the left side wall 10*d*) of the facing walls of the terminal accommodating chamber (12) and configured to lock the terminal (31) to restrict a movement of the terminal (31) in a terminal detachment direction, a recessed groove (14) provided on the second wall (the right side wall 10*c*) of the facing walls, extends from the rear side of the connector housing toward a front side of the connector housing along a terminal insertion direction of the terminal (31) being opposite to the terminal detachment direction, and has a groove width smaller than a width of the base plate portion (36), and a contact surface (18) formed at a front end of the recessed groove (14), in which when the terminal (31) is reversely inserted, tip end contact portions (32*a*) of the elastic curl portions (32) are brought into contact with the contact surface (18) to prevent the terminal (31) from being inserted further.

[2] The connector (1) according to [1], in which the contact surface (18) is provided on the second wall (the right side wall 10*c*) such that an electric wire connection portion (35) of the terminal (31) protrudes outside from a rear side of the terminal accommodating chamber (12) in a state in which the terminal (31) is reversely inserted and is prevented from being inserted further.

[3] The connector (1) according to [1] or [2], in which the contact surfaces (18) is provided on the second wall (the right side wall 10*c*) such that the base plate portion (36) of the terminal (31) is elastically biased toward the second wall (the right side wall 10*c*) by the flexible locking piece (the lance 13) in a state in which the terminal (31) is reversely inserted and is prevented from being inserted.

[4] The connector (1) according to any one of [1] to [3], further including another recessed groove (14) provided on the second wall (the right side wall 10*c*), extends from the rear side of the connector housing (10) toward the front side of the connector housing (10) along the terminal insertion direction, and has a groove width smaller than the width of the base plate portion (36), in which the recessed groove(14) and the another recessed groove (14) extend in parallel to each other in correspondence with an interval between the pair of elastic curl portions (32, 32).

According to the connector having the configuration of the above [1], when the terminal is inserted into the terminal accommodating chamber from the rear side of the connector housing in an appropriate insertion direction, the base plate portion of the terminal is brought into sliding contact with the second wall of the facing walls where the recessed groove is formed, and the elastic curl portions of the terminal elastically deform the flexible locking piece. Since the base plate portion has a width larger than the groove width of the recessed groove, the terminal is not introduced into the recessed groove and is not brought into contact with the contact surface. Then, when the terminal is completely inserted while the flexible locking piece is elastically deformed, the flexible locking piece restores to the original position due to a restoring force and locks the terminal to restrict a movement of the terminal in the terminal detachment direction. Therefore, the terminal is prevented from coming off from the terminal accommodating chamber by the flexible locking piece.

When the terminal is inserted into the terminal accommodating chamber in an inappropriate reverse insertion direction, the elastic curl portions of the terminal are brought into sliding contact with the second wall of the facing walls where the recessed groove is formed, and the base plate portion of the terminal elastically deforms the flexible locking piece. At this time, the tip end contact portions of the elastic curl portions having a width smaller than a width of the base plate portion are introduced into the recessed groove provided on the second wall of the facing walls. When the terminal is inserted halfway, the tip end contact portions of the elastic curl portions that are introduced into the recessed groove is brought into contact with the contact surface, so that the terminal is prevented from being inserted into the terminal accommodating chamber and the terminal is not completely inserted. Therefore, a reverse insertion of the terminal can be prevented. That is, the flexible locking piece does not need to be integrally provided with a rib for preventing the reverse insertion of the terminal. Rigidity of the flexible locking piece is increased due to the rib that is integrally provided with the flexible locking piece. Therefore, an increase in a force for elastically deforming the flexible locking piece due to an increase in the rigidity of the flexible locking piece does not occur. Therefore, according to the connector having the configuration, it is possible to prevent a reverse insertion when the terminal is inserted into the terminal accommodating chamber and it is possible to prevent an increase in the terminal insertion force.

According to the connector having the configuration of the above [2], in a case in which the terminal is inserted into the terminal accommodating chamber in an inappropriate reverse insertion direction, when the tip end contact portions of the elastic curl portions are brought into contact with the contact surface to prevent the terminal from being inserted, the electric wire connection portion of the terminal protrudes outside from the rear side of the terminal accommodating chamber. Therefore, the reverse insertion of the terminal can be easily detected (or known).

According to the connector having the configuration of the above [3], when the terminal is inserted into the terminal accommodating chamber in an inappropriate reverse insertion direction, the tip end contact portions of the elastic curl portions are brought into contact with the contact surface to prevent the terminal from being inserted further. At this time, when the base plate portion is elastically biased toward the second wall by the flexible locking piece, the tip end contact portions of the elastic curl portions can be reliably brought into contact with the contact surface. Therefore, a reverse insertion of the terminal can be reliably prevented regardless of dimensional tolerances of the connector housing and the terminal.

According to the connector having the configuration of the above [4], when the terminal is inserted into the terminal accommodating chamber in an inappropriate reverse insertion direction, the tip end contact portions of the pair of elastic curl portions are respectively brought into contact with the corresponding contact surface, and the terminal is reliably prevented from being inserted further. Therefore, a reverse insertion of the terminal in which the tip end contact portions of the pair of elastic curl portions are respectively brought into contact with the contact surface is reliably prevented.

What is claimed is:

1. A connector comprising:

a terminal comprising a base plate portion and a pair of elastic curl portions that are formed at two sides of the base plate portion and face each other from a front side to a rear side of the terminal;

a connector housing having a terminal accommodating chamber configured to receive the terminal from a rear side of the connector housing;

a flexible locking piece provided on a first wall of facing walls of the terminal accommodating chamber and configured to lock the terminal to restrict a movement of the terminal in a terminal detachment direction;

a recessed groove provided on a second wall of the facing walls, extends from the rear side of the connector housing toward a front side of the connector housing along a terminal insertion direction of the terminal being opposite to the terminal detachment direction, and has a groove width smaller than a width of the base plate portion; and a contact surface formed at a front end of the recessed groove, wherein when the terminal is reversely inserted, tip end contact portions of the elastic curl portions are brought into contact with the contact surface to prevent the terminal from being inserted further.

2. The connector according to claim 1, wherein the contact surface is provided on the second wall such that an electric wire connection portion of the terminal protrudes outside from a rear side of the terminal accommodating chamber in a state in which the terminal is reversely inserted and is prevented from being inserted further by the contact surface.

3. The connector according to claim 1, wherein the contact surface is provided on the second wall such that the base plate portion of the terminal is elastically biased toward the second wall by the flexible locking piece in a state in which the terminal is reversely inserted and is prevented from being inserted further by the contact surface.

4. The connector according to claim 1, further comprising:

another recessed groove provided on the second wall, extends from the rear side of the connector housing toward the front side of the connector housing along the terminal insertion direction, and has a groove width smaller than the width of the base plate portion, wherein the recessed groove and the another recessed groove extend in parallel to each other in correspondence with an interval between the pair of elastic curl portions.

* * * * *